US010088149B2

(12) United States Patent
Vissa et al.

(10) Patent No.: US 10,088,149 B2
(45) Date of Patent: Oct. 2, 2018

(54) ONE ATMOSPHERE BOILER INSTANT SUPERHEATED STEAM APPARATUS AND METHOD

(71) Applicants: Ramgopal Vissa, Hyderbad (IN); Jainagesh Sekhar, Cincinnati, OH (US); Venkata Burada, West Chester, OH (US)

(72) Inventors: Ramgopal Vissa, Hyderbad (IN); Jainagesh Sekhar, Cincinnati, OH (US); Venkata Burada, West Chester, OH (US)

(73) Assignee: MHI Health Devices, LLC, Cincinnati, OH (US)

( * ) Notice: Subject to any disclaimer, the term of this patent is extended or adjusted under 35 U.S.C. 154(b) by 628 days.

(21) Appl. No.: 14/425,086

(22) PCT Filed: Aug. 26, 2013

(86) PCT No.: PCT/US2013/056554

§ 371 (c)(1),
(2) Date: Mar. 2, 2015

(87) PCT Pub. No.: WO2014/035845

PCT Pub. Date: Mar. 6, 2014

(65) Prior Publication Data

US 2016/0018101 A1 Jan. 21, 2016

Related U.S. Application Data

(60) Provisional application No. 61/737,216, filed on Nov. 16, 2012, provisional application No. 61/721,100,
(Continued)

(51) Int. Cl.
*F24C 11/00* (2006.01)
*F22B 1/28* (2006.01)
(Continued)

(52) U.S. Cl.
CPC ..... *F22B 1/287* (2013.01); *F22B 1/00* (2013.01); *F22B 27/16* (2013.01)

(58) Field of Classification Search
CPC ..... F22B 1/278; F22B 27/16; F22B 1/00
(Continued)

(56) References Cited

U.S. PATENT DOCUMENTS 3,695,066 A 10/1972 Doyel
4,620,388 A 11/1986 Imawaga
(Continued)

FOREIGN PATENT DOCUMENTS

WO WO2008061139 5/2008
WO WO2014039296 3/2014

OTHER PUBLICATIONS

Han, Joong Sub International Search Report Written Opinion, dated Dec. 6, 2013, 11 pages.
(Continued)

*Primary Examiner* — Thien S Tran
(74) *Attorney, Agent, or Firm* — Michael C. Connelly

(57) ABSTRACT

An apparatus and method for the instant generation of superheated steam at normal atmospheric pressure are presented. Such an apparatus includes a water source, a means to convert the water to a mist or atomized droplets and a means to superheat the mist for application onto surfaces and objects. The apparatus and method are based upon the unique properties and behavior of misted water when it comes into contact with a heated surface, such behavior and properties resulting in the efficient and expansive release of energy and superheated steam. Such an apparatus can produce this steam at one atmosphere without the need of a boiler or other required high pressure fixtures or piping.

21 Claims, 6 Drawing Sheets

Related U.S. Application Data filed on Nov. 1, 2012, provisional application No. 61/696,417, filed on Sep. 4, 2012.

(51) Int. Cl.
*F22B 1/00* (2006.01)
*F22B 27/16* (2006.01)

(58) Field of Classification Search
USPC ..... 219/245, 443.1, 494, 535, 541; 392/400, 392/403, 441
See application file for complete search history.

(56) References Cited

U.S. PATENT DOCUMENTS 4,637,161 A 1/1987 Turner
4,716,676 A 1/1988 Imawaga
4,756,118 A 7/1988 Evans
5,378,086 A 1/1995 Campbell
5,449,886 A 12/1995 Zhu
5,565,387 A 10/1996 Sekhar
5,848,492 A 12/1998 Brown
5,867,935 A 2/1999 Brown
6,029,589 A * 2/2000 Simpson ..... A01M 21/04 111/127
6,635,149 B1 * 10/2003 Campbell ..... B01D 1/0017 159/44
7,155,117 B2 12/2006 Leung
7,752,802 B2 7/2010 McDonald
7,797,878 B2 9/2010 Schuster
8,435,459 B2 5/2013 Reddy
2002/0100433 A1 * 8/2002 Uchiyama ..... A61L 2/07 122/459
2003/0062004 A1 * 4/2003 Hays ..... B01D 1/0011 122/40
2007/0145038 A1 6/2007 Vissa et al.
2009/0133645 A1 * 5/2009 Yao ..... A61H 33/12 122/407
2009/0139550 A1 7/2009 Lim
2009/0313767 A1 12/2009 Tanner
2010/0092163 A1 * 4/2010 Yeung ..... F24H 1/106 392/441
2011/0041782 A1 2/2011 Vaughn
2012/0039586 A1 * 2/2012 Collinson ..... D06F 75/12 392/400

OTHER PUBLICATIONS

Cengel & Boles, Basic Thermodynamics: An Engineering Approach, McGraw Hill, 6th edition 2011.
Block, et al., Practical Guide to Steam Turbines, ISBN 13 978-007 150 8216.

* cited by examiner

ONE ATMOSPHERE BOILER INSTANT SUPERHEATED STEAM APPARATUS AND METHOD

CROSS-REFERENCE TO RELATED APPLICATIONS

This application claims the benefit of U.S. provisional applications 61/696,417 filed on Sep. 4, 2012; 61/721,100 filed on Nov. 1, 2012; and 61/727,216 filed on Nov. 11, 2012 by the applicants. This application also utilizes features disclosed in U.S. patent application Ser. No. 11/682,107 filed on Mar. 5, 2007 as well as PCT Application No. PCT/US07/84670, entitled "Heating and Sterilizing Apparatus and Method of Using Same" filed on Nov. 14, 2007 the disclosures of which are all hereby incorporated by reference herein in their entirety.

BACKGROUND

Superheated steam has many commercial, industrial and consumer applications. It is important in power and energy generation and may be employed in production processes including surface preparation and treatment. Superheated steam has also proved to be effective in the control, removal and destructions of unwanted microorganisms and common household pests.

Commonly, in the prior art, steam is produced in a boiler or other vessel at high pressures. If desired, this steam at elevated pressure is further heated by various means to achieve a superheated state (above 100° C.). In many cases the combustion of fuels is employed to heat the water with an open flame boiler and produce steam. This combustion creates carbon monoxide and other pollutants. The heat produced by combustion, solar or nuclear processes is often converted to work energy via steam production. Use of these types of systems would be limited to open and unconfined areas and may require filtering means for any exhaust.

The prior art contains examples which disclose devices utilizing steam, sometimes superheated, to destroy insects and various other pests. U.S. Pat. No. 7,797,878 to Schuster (2010) presents a device to suppress fire ants utilizing the injection of superheated steam into an ant colony. This invention has several limitations. It is heavy, bulky and relies upon a handcart for ease of movement. The generation of superheated steam employs a complicated system to create steam and then reheat it to a superheated state. This invention only performs its intended purpose when a probe is driven into the ground to reach insects.

Likewise, U.S. patent application Ser. No. 12/757,969, published as 2011/0041782, by Vaughan presents a device to control pests and weeds utilizing steam, sometimes superheated, and hot air. This system is bulky and requires a cart with wheels for transportation. It is not compact and its usage in tight areas would be very limited. The system is complicated, needing a burner to heat water into steam, an electric blower to move the air and a means to pump the needed water. Also, instant steam is not produced.

U.S. Pat. No. 5,867,935 (1999) and U.S. Pat. No. 5,848,492 (1998), both to Brown, present an invention intended to apply superheated steam in agricultural applications to defoliate and to eliminate insect pests. This apparatus is large and very heavy. One embodiment is equipped with wheels in order that it may be pulled by a tractor or other means into position. It can only be utilized outdoors or where there is plenty of space. Indoor use is limited, if at all possible, in most situations. The system used for the heating and the projection of the steam is also complicated and does not produce instant steam.

U.S. Pat. No. 5,378,086 to Campbell, Jr. (1995) can utilize superheated steam, but is not portable. Rather, it is a permanent underground system for pest extermination. U.S. Pat. No. 4,620,388 (1986) and U.S. Pat. No. 4,716,676 (1988), both to Imagawa, are large stationary systems for the elimination of pests on, or in, fruit such fruit being placed inside of the invention. These three inventions have very limited, specific and non-portable intended applications and teach away from instant superheated steam.

U.S. Pat. No. 4,756,118 to Evans, II (1988) has a handheld applicator, but has a fuel and gas source that both are external to the applicator making it bulky and complicated. Gas is vaporized by a flame and then injected into fire ant colony. It is not intended to be used in any other manner, thereby limiting possible applications. Also, pure steam is not produced with the steam containing other gases as well.

U.S. Pat. No. 4,637,161 to Turner (1987) and U.S. Pat. No. 7,752,802 to McDonald (2010) are intended for underground elimination of ants and must be set up, inserted in the ground and used in place. They are thus not handheld and are limited in their usage.

U.S. Pat. No. 7,155,117 to Leung et al. (2006), U.S. Pat. No. 3,695,066 to Doyel (1972) and U.S. application Ser. No. 12/341,614 published as 2009/0313767 by Tanner et al. are handheld steam generators designed generally for the removal of wrinkles from fabric or clothing. Each is fairly complicated, either electronically or mechanically, and none is designed to produce superheated steam. These inventions are meant to be in close physical contact with a work-piece and will not function effectively if not. Usefulness for other purposes is thereby greatly diminished.

Steam is produced in boilers for mechanical work production. A boiler operates on the $P_{sat}$–$T_{sat}$ equilibrium principle. Rapid heat-up and rapid turn-off are not associated with boilers especially when high powers are desired. On account of the $P_{sat}$–$T_{sat}$ limits of boilers, the controllability of them is very low.

There is a need for an efficient, effective and instant electrically powered superheated steam generation system that performs this function without a conventional boiler at atmospheric temperature. An apparatus of this type would be safer, cleaner, greener, faster, less expensive and more efficient that current steam generation equipment and methods. Table 1 is a comparison of expected differences between boiler steam and superheated steam (please see http://www.mhi-inc.com/oab-superheated-steam-generator.html).

SUMMARY OF EXEMPLARY EMBODIMENT

An exemplary embodiment of the present application will use water in a mist or droplet form applied to heated surfaces or heating elements to almost instantly, efficiently and controllably convert the water into superheated steam. The method and apparatus of this embodiment will perform the generation of superheated steam at one atmosphere without the need of a conventional boiler and all the drawbacks that the use of such entails. The generation of steam may be started and stopped quickly as desired.

The apparatus of the exemplary environment is comprised of a water supply, a water misting means, a superheated steam generator comprising, a steam chamber, heated surfaces, a steam outlet and a means of application. A supercharger that can also handle any residual mist may also be included to heat the superheated steam to even higher temperatures.

The exemplary, and further, embodiments of the instant steam apparatus may use greater than 2/r for a surface area/heat volume equivalent wire heater where r is the diameter of the heating wire. It is also envisioned that flat heaters or elements may be used as well. Several of the element shapes and types are disclosed in U.S. Pat. No. 5,449,886, U.S. Pat. No. 5,565,387 having electrical conductivity and other publications and are incorporated by reference in their entireties.

A key part of the apparatus and method is related to boiling efficiency. It has been determined, for this apparatus, that liquid from a spritzer or atomizer (misting means) or in the form of a film applied to a hot surface are effective forms of liquid for the production of instant steam. It has also been found that 18 ml/min of atomized or misted water applied to a surface at a temperature greater than 100° C. with a heat content of greater than 2 kJ will produce instantly boiled water at a rate of 1 kg/hr. The apparatus of this application teaches away from commonly known principles of boiling (Steam textbooks such as "Practical Guide to Steam Turbines" ISBN 13 978-007 150 8216 by Block and others).

In operation, water will be drawn from a reservoir and converted to a fine mist or into droplets by a spray control nozzle, or other means, and immediately injected onto hot surfaces or hot electric heating elements located within the steam chamber. Nozzle size can be 0.5 mil to 20 mil (1 mil=1/1000 inch). The water is not required to be heated before conversion to mist or injection into the generator but may be if desired. When the mist enters the chamber it will come into immediate contact with heated surfaces found within and be instantly converted into superheated steam. The hot surfaces may be made of materials including but not limited to metals, non-metals, semiconductors, ceramics, plastics, polymers composites and metal-like materials. The chamber will be insulated in such a manner as to allow the conversion of the water droplets into superheated steam. Insulation material used may be those commonly known to those skilled in the art. This apparatus and method provides a steam making rate that far surpasses that found in the prior art.

The high rate of steam production is accomplished in part due to the nature of atomized water. Tiny water droplets found in misted water may produce 1000 times its volume in steam when it comes in contact with heated surfaces. If these heated surfaces experience radiative, convective or conductive heat in an extremely well insulated chamber the steam may become superheated. The apparatus of the present application provides these conditions. The hot surfaces are high electron conductivity surfaces with electrons in the conduction band. The apparatus and method avoid line phase spinodals and produce a high purity gas that is waterless. The apparatus ascends $P_{sat}$, $T_{sat}$ and all spinodals along the two phase boundary of water/steam (See Cengel and Boles, Thermodynamics: An Engineering Approach, McGraw Hill, $6^{th}$ edition 2011.). Mist and steam are allowed to pre-mix.

The apparatus and method of the present application require only the heating of a mist to steam. No heater is needed to heat the water to an initial gaseous state prior to superheating. The steam is truly produced on demand since no steam is ever present until the misting means is actuated and a mist of water is projected onto the hot surfaces providing instant steam. There is no wait as the steam is produced when the mist contacts the heated surfaces contained within the chamber. Current standard boilers have to be idled. Once the hot surfaces are at operating temperature the apparatus will instantly produce steam, and thus the only time needed is the time necessary to convert water to mist and contact the mist to the heated surfaces within the chamber.

A major feature of this apparatus and method is the instant conversion of liquid to gas. It is well known that boiling of a liquid is a difficult phenomenon when the liquid is confined within a container such as a can or a cup. This difficulty has been overcome by the embodiments of the instant superheated steam apparatus disclosed herein.

Embodiments may be handheld or of a larger, but still portable size (in the agro industry, for example). The apparatus offers a portable unit capable of easily being transported to the point of use and able to be operated effectively in confined spaces. Small and large units for use in cleaning, sterilizing, de-wrinkling, biomass conversion, food preparation, coloring processes, standard power generation and the quick generation of fresh water from sea or salt water are easily envisioned.

For instant boiling the temperature of the surface should be greater than 100° C. While boiling the temperature of the surface should not fall below a certain value. Surfaces with a temperature of >100° C. have an approximate heat content of 2 kJ. Those with a surface temperature of >200° C. have an approximate heat content of 1 kJ while surfaces with a temperature of >300° C., >400° C., >500° C. and incrementally up to >2000° C. have decreasing approximate heat contents respectively depending on the specific heat. This kW of power being applied (1-1000) and kJ of retained power (0.5-1000) and temperature of surface influence the boiling time and boiling efficiency as well as antimicrobial efficiency.

Hybrid heaters, i.e. using electrical, magnetic, combustion (and combustion gases), electrochemical, electrostatic and other means are fully contemplated. If used for power generation, a part of the power can be used for keeping the heating elements hot. Co-generation is fully possible, i.e. combinations of heat and work can be outputted for the steam produced.

DRAWINGS—FIGURES

DRAWINGS - REFERENCE NUMERALS

Figure 1:
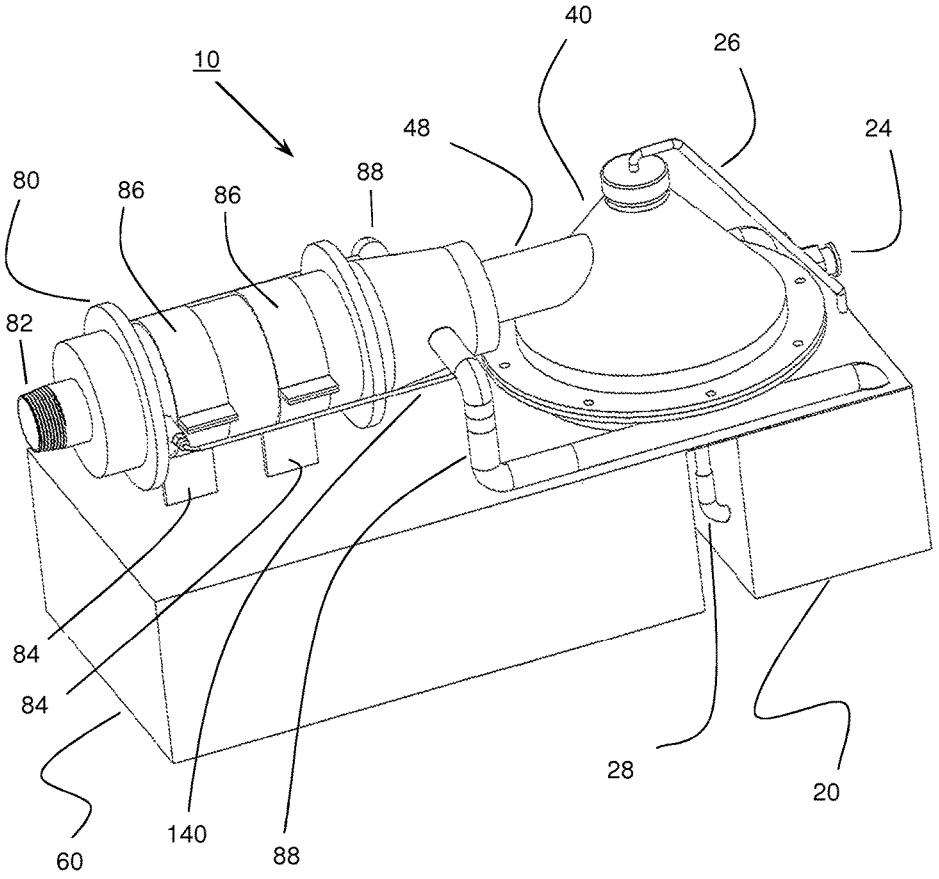
FIG. 1 is an overall view an embodiment of the one atmosphere boiler superheated steamer apparatus.

| | | | |
|---|---|---|---|
| 10. | one atmosphere boiler steamer | 20. | water reservoir |
| 24. | water inlet | 26. | water feed tube |
| 28. | water return tube | 40. | superheated steam generator |
| 44. | steam chamber | 46. | steam chamber cover |
| 48. | steam outlet | 50. | chamber base |

-continued

| DRAWINGS - REFERENCE NUMERALS | |
|---|---|
| 52. chamber flange | 56. cap |
| 60. base | 80. supercharger |
| 82. supercharger outlet | 84. front supercharger support |
| 86. supercharger retaining band | 88. rear supercharger support |
| 100. heating element | 120. Mister |
| 140. thermocouple | |

DETAILED DESCRIPTION

Figure 2:
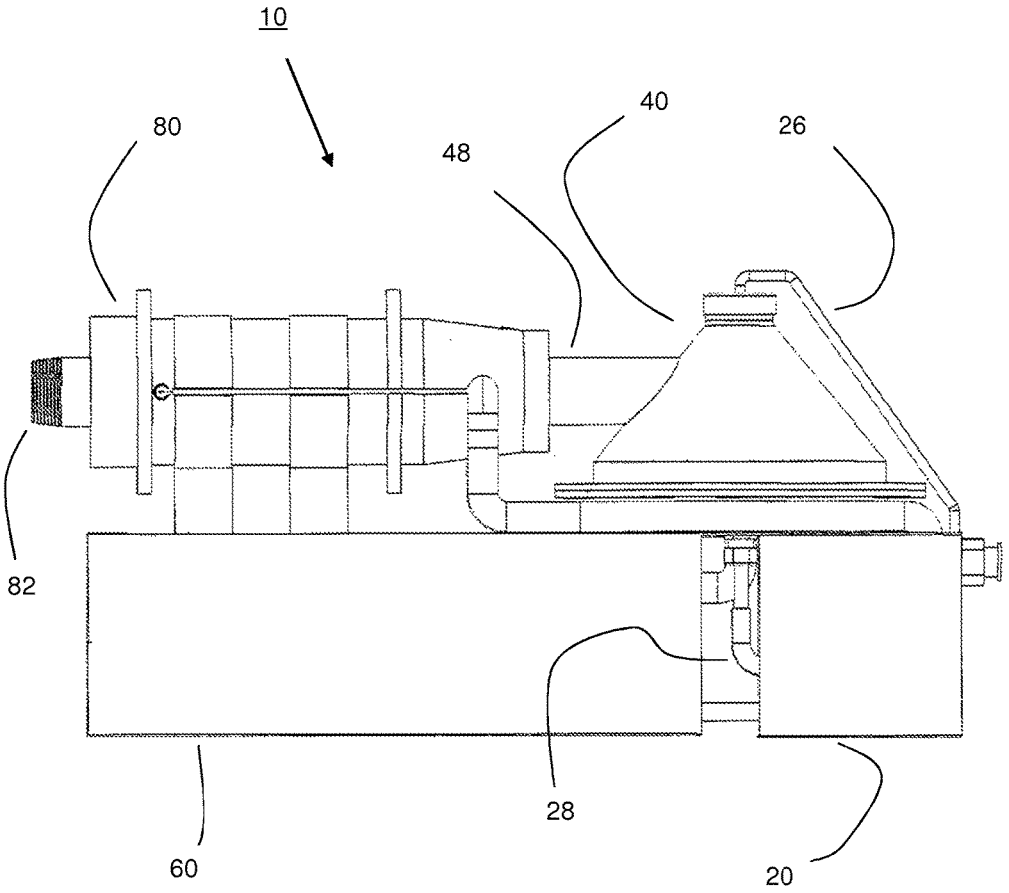
FIG. 2 is a side-view an embodiment of the one atmosphere boiler superheated steamer apparatus.
Figure 3:
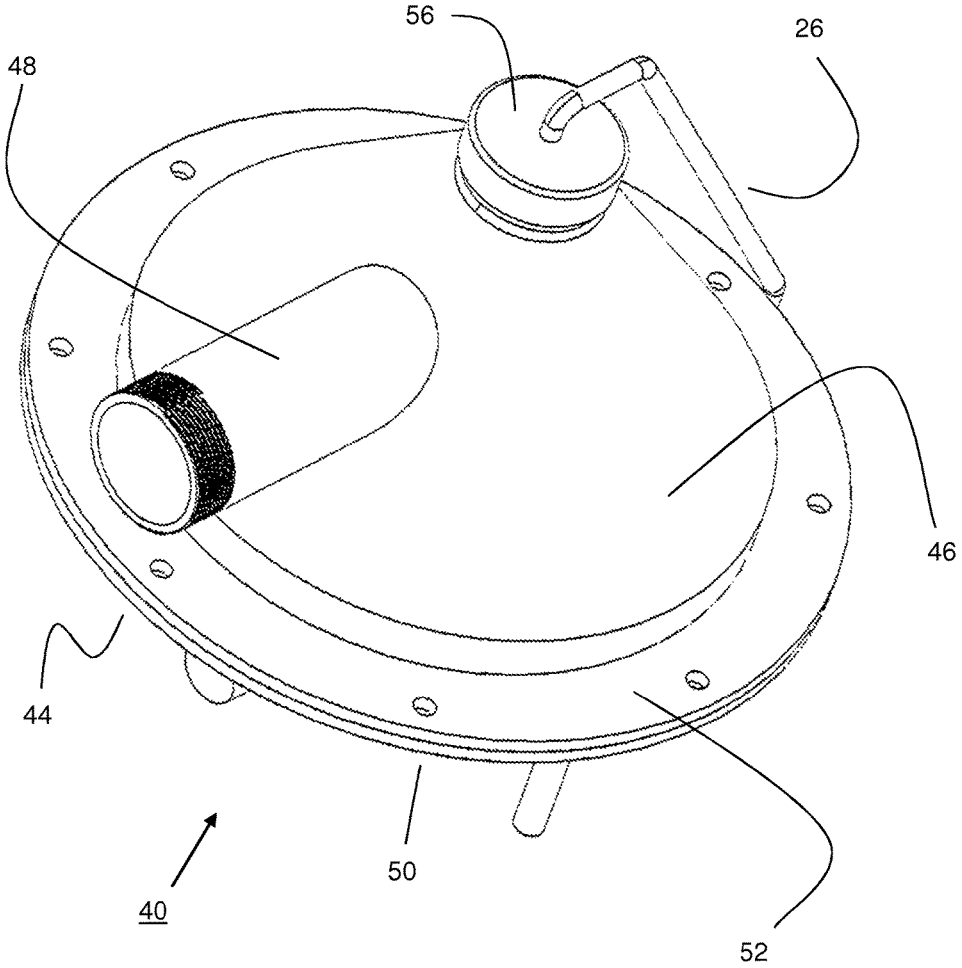
FIG. 3 is a view of the steam chamber of the one atmosphere boiler superheated steamer apparatus.
Figure 4:
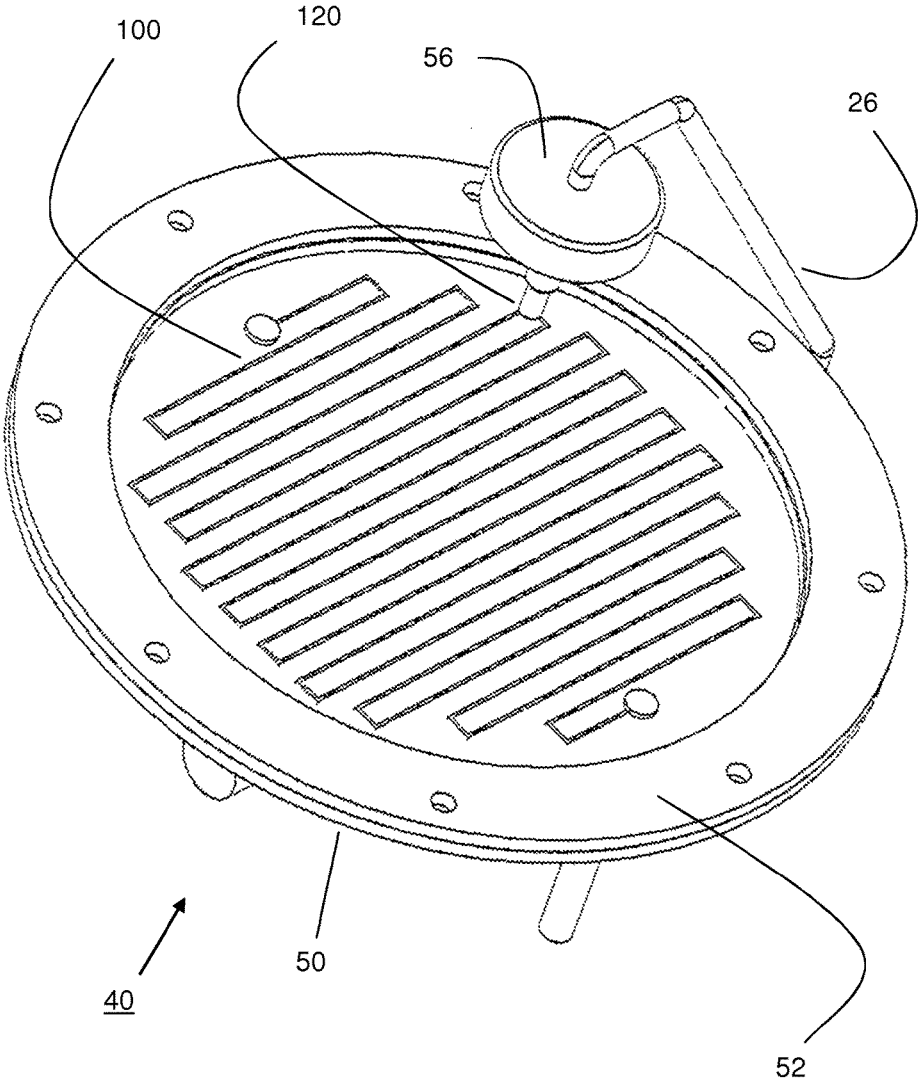
FIG. 4 is a view of the steam chamber of the one atmosphere boiler superheated steamer apparatus without the steam chamber cover.
Figure 5:
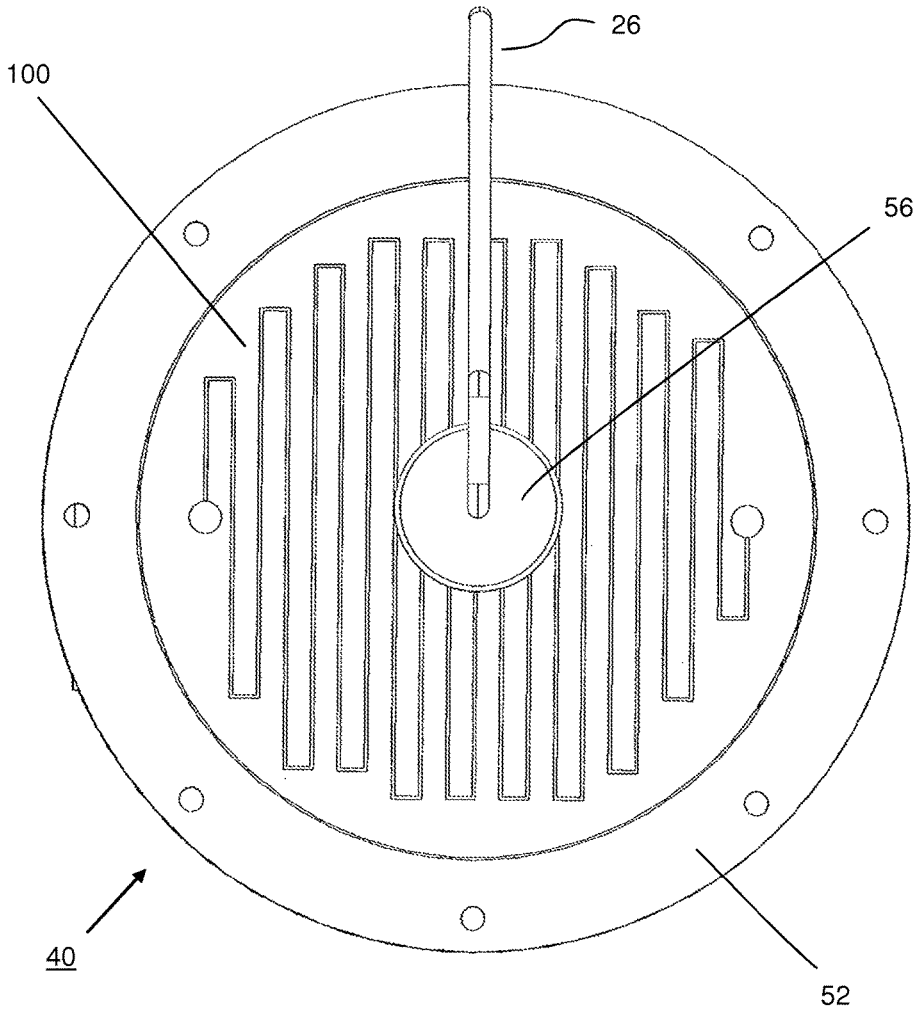
FIG. 5 is a view of the heated surfaces located within the superheated steam generator.
Figure 6:
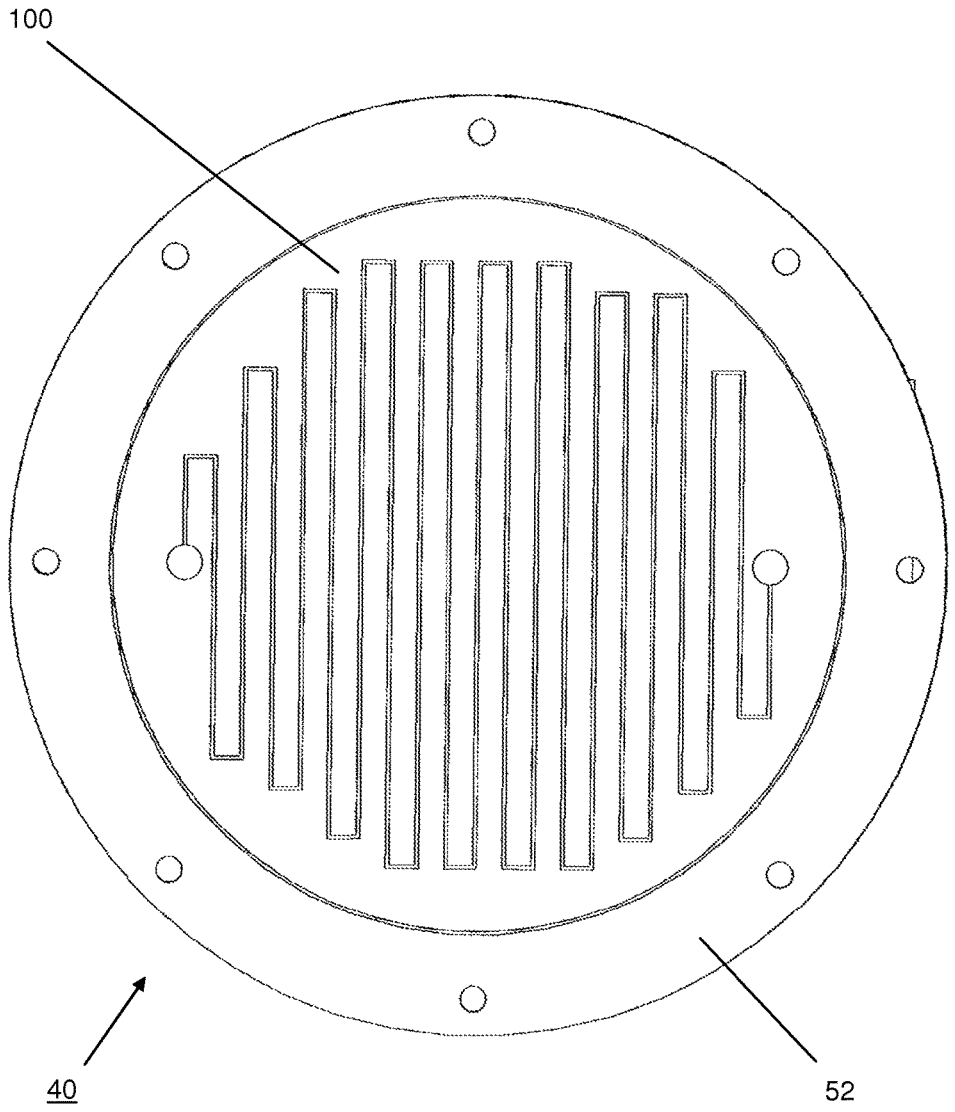
FIG. 6 is a view of the heated surfaces located within the superheated steam generator.

A preferred embodiment of the one atmosphere boiler superheated steam apparatus 10, as shown in FIGS. 1 and 2, comprises water reservoir 20 and superheated steam generator 40. The water reservoir 20 employs a pump (not shown) or other means located within or outside of the reservoir 20 and supplies water to the generator 40 through water feed tube 26. The generator 40 comprises steam chamber 44, steam outlet 48, steam chamber cover 46, chamber flange 52, cap 56 and heating element 100 shown in FIGS. 1-6. A supercharger 80 is connected to the steam outlet 48 to increase the temperature of the superheated steam to desired higher temperature levels.

In this embodiment the generator 40 and the supercharger 80 are positioned on top of a base 60 and a water reservoir 20. The supercharger 80 is affixed to front supports 84, which are attached to base 60, by retaining bands 86. The supercharger is also rigidly connected to the water reservoir 20 by rear supports 88. The generator 40 rests upon the arms of rear supports 88 and is connected to the reservoir 20 by water feed tube 26 and water return tubes 28.

Generator 40 comprises a steam chamber 44 which defines a hollow interior space containing a mister 120 and a heated surface or heating element 100. In this embodiment the steam chamber 44 is comprised of a steam chamber cover 46 which has a steam outlet 48 projecting outwardly from it and parallel to the heating element 100. The steam chamber 44 further comprises a chamber base 50 and a flange 52 which acts to hold the cover 46 and the base 50 together with bolts. A cap 56 may be found at the top of the cover 46 through which the water feed tube passes for connection with the mister 120. The cap 56 may be threaded onto the top of the cover 46 for ease of assembly and maintenance. The cover 46 and chamber base 50 define a hollow interior space having a top and a bottom. In the case of the preferred embodiment this interior space is conical in shape with the wide side of the cone being delineated by the base 50 and with cap 56 positioned at the top of the cone. The interior space is not limited as being conical in shape but is envisioned in other embodiments as being tubular, round or spherical. The heating element 100 is located at the bottom of the interior space in the chamber base 50. The mister 120 is positioned at the top of the interior space directly above the center of heating element and at the chamber base 50. This central positioning will permit the mist projected by the mister 120 to come in contact with the entire heating element 100 surfaces.

The mister 120 is designed and positioned to project the mist so that the entire heated surface is contacted. Further embodiments envision multiple misters employed to cover a greater area of the heating element 100. The vertical distance of the mister to the heating element 100 may be adjusted to obtain the optimal mist coverage to achieve the desired superheated steam generation efficiency. It is also anticipated that the mister 120, may be designed with various outlet configurations to give more or less of a fine mist, droplets or even a stream of water. The mister 120 will be configured to produce various patterns or shapes of the area covered by it. The mister may be single or multiple headed. It may also be configured with venturi tubes to provide added pressure and velocity to the mist. The mist may be put down in a circular, semicircular, fan shape or linear pattern depending on the desired application needs and the heating element 100 configurations.

Operation

The operation of the present apparatus is based upon the nature and behavior of very fine droplets of water that sizzle and boil when applied to heated surfaces. Large amounts of energy are quickly transferred due to the rapid formation of superheated steam and the great expansion in volume of the water droplets to steam. In this type of application such a rapid formation of steam is new to the art. The rapid expansion of the droplets into steam and the resulting energy release help to propel the steam out of the steam generator and onto objects and surfaces. The apparatus operates at one atmosphere and does not build up pressure since the steam is allowed to flow freely out of the steam chamber 44 through the steam outlet 48 and the supercharger 80. Relief valves are contemplated and may be used to ensure that the apparatus is kept at atmospheric pressure if desired.

Atomized droplets constitute an unstable fluid stream. A process central to the innovative operation of this apparatus is that of unstable fluid streams impacting on hot surfaces that, as a result, form electrons in the conduction band and which may provide the advantages described herein. In particular, the mist or unstable fluid stream impinges on a very hot surface, preferably where electrons are in the conduction band, and thereby produce instant boiling. The hot surface is envisioned as a heating element or a metal, ceramic or plastic-like surface. The spinodal region of the $P_{sat}/T_{sat}$ curve is avoided and thus high purity gas (waterless steam) is produced. Films of trapped steam that normally reduce boiling efficiency are overcome by the present application. Boiling films that are problems in normal boilers can be avoided and quick antimicrobial or electric work can be accomplished.

Operation of the preferred embodiment is simple and straightforward. Upon activation of a pump mechanism located within or contiguous to reservoir 20, water is drawn from reservoir 20 through water feed tube 26 and is turned into fine droplets or a mist by mister 120. Such misting devices are commonly known to those skilled in the art. The mister 120 then projects the water mist or droplets onto a heating element 100, located directly below the mister 120. Inside the generator 40 the mist is projected out of the mister by pressure created by the pump and subsequently contacts the heating element 100 and is instantly converted into superheated steam. The steam produced builds up in volume to a point that it expelled from the generator 40 via its own energy and expansion and then is applied to objects through steam outlet 48. An optional supercharger 80 may be attached to the outlet 48 to heat the superheated steam to an even greater temperature, if desired.

The rate of steam production is superior to that of the current art. Superheated steam is instantly produced, and due to its energy, may be applied to surfaces without a fan, compressor or other means of projection. The only mechanical instrumentation in the apparatus is a means to pump the water from the reservoir 20 through feed tube 26 to the mister 120 where it is then applied to the heating element 100. Steam production rates of 10-18 kg/hr are anticipated.

18 kW superheaters as well as 6.5 kW pancake heaters are anticipated as well by the applicants.

It is envisioned that the apparatus may be used with other liquids besides water, thereby producing a high temperature gas or vapor other than steam. It is also envisioned that additives may be added to the water to produce desired attribute to the resulting steam. Such additives may include, but are not limited to disinfectants, antimicrobial agents, colorants, scents and $CO_2$ producing agents.

Safety devices may be included on the steamer for protection of the user and surroundings. A whistle or other noise making means is contemplated. Such a means may be included on the steamer apparatus as a warning that the device is operating and steam is being produced and expelled. The noise making means would function when steam is being expelled from the apparatus and the volume of the means would increase as the volume of steam expelled increases. The steamer may be configured to include such a means on the outlet of the steamer or in other locations that may be convenient. The means may be comprised of a ceramic or other high temperature resistant material. A whistle may be configured from a piece of ceramic tubing with a notch cut therein. The means may also indicate a decrease in pressure in the reservoir or a decrease in the level of the fluid. Such is indicated by a change in pitch of the noise or whistle. Blowers, fans and pumps for fluid motion or cooling in the device are fully contemplated as well.

Embodiments using various heating element (defined as hot surface) shapes, materials and configurations are contemplated as well. The elements may be flat, round, straight, bent, u-shaped, coiled, round coil, square coil, coil-in-coil and circular spiral, ovoid, coated, bare, and smooth or textured. The elements or heated surfaces of whatever configuration may be hollow. Other shapes and configurations may work as well and the applicant does not intend the above listing to be limiting. Heating elements capable of reaching temperatures up to 2500° C. may be utilized in the apparatus or superheated steam generation process. Various optimal temperatures have been determined that will limit and control the formation of oxidation on the elements. For example, iron or iron based elements need to be operated at a temperature above 1000° C. to minimize and control oxidation. It is anticipated the process of directly applying misted or aerated water or water in small droplet form on a hot surface will instantly produce superheated steam. It has been found that the heating elements in these applications must not be subject to torsion or torsion fatigue or resultant failure may occur. The output will have good steam of high thermal and mechanical energies. This steam can be safely sent through pipes if required.

In a further embodiment, after water mist or droplets are brought into contact with heated surfaces and instantly converted into superheated steam, the steam is further heated and supercharged and raised to an even higher superheated temperature. The heated surfaces may be contained within, possibly at the bottom, of a conical shaped chamber. The misted water or water droplets are injected into the smaller and upper portion of the chamber and dispersed upon the heated surfaces. The steam collects within the chamber and exits the chamber through the supercharger. A further step in the process is thus added by the supercharging for heating the steam to a heightened state before application onto surfaces. The resulting supercharged steam is then projected onto surfaces. As with previous embodiments, no boiler is needed to produce the initial steam and the whole process can be carried out at atmospheric pressure.

Envisioned as well, in a handheld embodiment with a tubular body and a coiled heated surface, is water cooling lines being wrapped around the electrically powered heater. Water from the reservoir or from another source may be employed to cool the heater. A casing may then be placed around the coil and heater. Embodiments of the apparatus are illustrated by the following experiments. In such a handheld embodiment it is contemplated that a fine mist or droplets of water are projected into the tubular body where it comes into contact with the heated surface, in this case in the form of coiled heating elements. The elements may be in other configurations as well. Such an apparatus may be equipped with the safety features mentioned above and also have needed electronic controls and external or internal pumping mechanisms as needed as would any embodiment of the apparatus. In this embodiment, as in all others, the key feature is an interrupted water flow (mist, droplets, etc.) coming into contact with hot surfaces, thus creating superheated steam without the use or need of a boiler and its associated training, expense, hazards and fixturing.

Although pressure is best kept at one atmosphere for most commercial operations, there is no reason that higher pressures cannot be produced. The conversion between PV and kinetic energies are envisaged.

Experiment 1:

Water was streamed onto a 1000° C. heating element with a flat surface. The heating element was active, i.e., energized and heated to above 1000° C. prior to starting the steam flow. The heating element consisted of a flat fine surface and composited and nanostructured surface. Heating elements may be up to a 2500° C. type. The steam generation process can also act to prevent oxidation type degradation of many heating elements including Silicide, oxides, nitrides, metallic, carbides and boride type heating surfaces. Heating elements may be layered or composited to create variations. Heaters may be in parallel or series or in complex 3D arrangements. A supercharger to further heat steam was used in this experiment.

TABLE 1

Experiment 1 Results.

| | |
|---|---|
| Total Water in Reservoir | 24000 ml |
| Remaining Water in Reservoir | 6940 ml |
| Conversion Water | 17060 ml |
| Run Time | 180 mins |
| Conversion Per Hour | 5686.67 ml |
| Conversion Per Minute | 94.7778 ml |
| Steam Generator (IB) Power | 5587.8 Watts |
| IB Exit Temp | 436.7° C. |
| Supercharger (SC) Power | 901.9 Watts |
| SC Exit Temp | 547.6° C. |
| IB Conversion/kW/Hr. | 1017.7 ml @ 436.7° C. |

Experiment 2:

Water was streamed on to a 1000° C. heating element with a flat surface. The Heating element was active, i.e. energized and heated to above 1000° C. prior to starting the steam flow. Heating elements can be up to a 2500° C. type. The steam generation process can also act to prevent oxidation type degradation of many heating elements including Silicide, oxides, nitrides, metallic, carbides and boride type heating surfaces. Heating elements can be layered or composited to crate variations. Heaters may be in parallel or series or in complex 3D arrangements. In this experiment hot water excess was reintroduced to water reservoir in order to improve energy efficiency.

TABLE 2

| Experiment 2 Results. | |
|---|---|
| Total Water in Reservoir | 45000 ml |
| Remaining Water in Reservoir | 10480 ml |
| Drain Water | 6100 ml |
| Steam Generator (IB) Power: | 12 kW-16 kW |
| IB shape: | Conical |
| Heating element | Flat metallic Boack strip |
| Conversion Water | 28420 ml |
| Run Time | 150 min |
| Conversion per hour | 11368 ml |
| Conversion per minute | 189.46 ml |

A system utilizing hybrid heating is also anticipated where, along with instant steam being produced through the contact of water with electrically heated surfaces, a combustion gas is utilized as well. The energy efficiency of such a system would be an increase over that of the prior art. A hybrid system would efficiently produce heat and work from the combustion of the gas as represented by the equation $(T_1-T_2)Q/T_2$, ($T_1$=higher temperature; $T_2$=lower temperature; Q=amount heat transferred between $T_1$ and $T_2$) while offering the benefits of the instant production of steam via the reaction of the misted water on the hot surfaces. The use of electricity alone to heat a surface is inherently less efficient in producing work than in using a combustion reaction since some form of combustion or other reaction occurred to originally produce the electricity. Naturally ensuing losses would be less where the combustion itself generates the heat, or augments the heat, produced by electricity to heat the surfaces of the present application.

An embodiment is therefore envisioned where a means of combustion is directed onto the surfaces thereby heating them to a temperature necessary to convert water to instant steam as described above. The combustion means may be a burning gas and may be the sole provider of heat to the surfaces or may be used along with electrically or otherwise activated heat sources in a hybrid manner. Hollow configured electric heating elements may contain combustion gases for a combined heat. Other heat sources that may be used in a hybrid manner may comprise magnetic heat, radiation heat, friction heat or electron heat, etc.

Embodiments may also comprise thermocouples for temperature readout or control. Insulation may be provided when necessary around the steam chamber cover, steam outlet, supercharger or wherever needed for safety. Other features that embodiments may comprise include but are not limited to the following: external power supply, power control, external water pump, steam trap, excess water line, drain and collection vessel, pressure valves, temperature readout and/or external water supply. Steam with ozone and ozone like products is feasible in other embodiments. Other chemicals can be introduced into either fluid, i.e. prior to misting or after gassification or at both stages. Chemicals that alter surface tension of the mistable liquid are fully considered as well.

The heating elements may be silicides and other non-metallic materials. They can be comprised of materials that contain Ni, Fe, Cr, stainless steels, Al, and Co. The heating elements may have graded layers, including coatings and nano-structures. Nano-features and nano-elements are fully envisioned as well such as disclosed in U.S. patent application Ser. Nos. 12/092,923, 13/318,366, 13/656,870 and 13/877,345 filed by the present applicants which are incorporated by reference in their entirety. Such materials would provide better erosion and corrosion (including biochemical corrosion) protection. Use of other liquids, suspensions, oils and colloids for making novel output gas or gas-steam mixtures is contemplated including organic and inorganic materials (salts, metal, liquids, mists, etc.).

What is claimed is:

1. A one atmosphere superheated steam generator comprising; a water source; a misting means to convert water from the water source into a mist; and at least one electrically conductive heating element wherein the at least one electrically conductive heating element is uncovered in the direction of the misting means and is positioned to be in direct contact with the mist and immediately convert the mist into superheated steam.

2. The one atmosphere superheated steam generator of claim 1 further comprising a steam outlet.

3. The one atmosphere superheated steam generator of claim 1 further comprising a means to apply the mist to the at least one electrically conductive heating element.

4. The one atmosphere superheated steam generator of claim 1 further comprising a supercharger positioned at the steam outlet for the increased heating of the superheated steam.

5. The one atmosphere superheated steam generator of claim 1 further comprising; a steam chamber, wherein the steam chamber defines an interior space having a top and a bottom wherein, the at least one electrically conductive heating element is positioned at the bottom of the interior space and the misting means is located at the top of the interior space, wherein the means to apply the mist is gravity.

6. The one atmosphere superheated steam generator of claim 5 wherein the steam outlet projects from the steam chamber parallel to the at least one electrically conductive heating element.

7. The one atmosphere superheated steam generator of claim 5 further comprising: a water feed line connecting the water source to the misting means, wherein the water feed line is positioned exterior to the steam chamber and projects through the top of the steam chamber.

8. The one atmosphere superheated steam generator of claim 1 where the at least one electrically conductive heating element is bare.

9. The one atmosphere superheated steam generator of claim 1 wherein the at least one electrically conductive heating element is heated by a combustible gas.

10. The one atmosphere superheated steam generator of claim 1 wherein the at least one electrically conductive heating element is heated by the combination of a combustible gas and electric power.

11. The one atmosphere superheated steam generator of claim 1 where the at least one electrically conductive heating element is in a shape from the group consisting of flat, round coil, square coil, coil-in-coil and circular.

12. The one atmosphere superheated steam generator of claim 5 where the steam chamber is in a configuration from the group consisting of tubular, conical, ovoid and round.

13. The one atmosphere superheated steam generator of claim 5 wherein the at least one electrically conductive heating element is positioned in line with the steam outlet.

14. The one atmosphere superheated steam generator of 1 that is configured to be handheld.

15. The one atmosphere superheated steam generator of 1 that is configured to be portable.

16. The one atmosphere superheated steam generator of claim 1 wherein the at least one electrically conductive heating element is comprised of graded layers.

17. A method for producing superheated steam at one atmosphere comprising: converting water into a fine mist or droplets; bringing the mist or the droplets into direct contact with at least one electrically conductive heating element wherein the at least one electrically conductive heating element is uncovered in the direction of the misting means whereby the mist is immediately converted into superheated steam.

18. The method of claim 17 wherein the at least one electrically conductive heating element is bare.

19. The method of claim 17 further comprising increasing the temperature of the superheated steam to a heightened state.

20. A method for treating objects and surfaces with superheated steam generated at one atmosphere comprising: converting water into a fine mist or droplets; bringing the mist or the droplets into direct contact with at least one electrically conductive heating element whereby the mist is immediately converted into superheated steam; projecting the superheated steam onto the objects and surfaces.

21. The method of claim 20 further comprising increasing the temperature of the superheated steam to a heightened state prior to application to the objects and surfaces.

* * * * *